United States Patent [19]

Yagher, Jr.

[11] Patent Number: 4,831,354

[45] Date of Patent: May 16, 1989

[54] POLYMER TYPE PTC ASSEMBLY

[75] Inventor: Charles Yagher, Jr., Richland County, Ohio

[73] Assignee: Therm-O-Disc, Incorporated, Mansfield, Ohio

[21] Appl. No.: 109,105

[22] Filed: Dec. 3, 1987

[51] Int. Cl.[4] ..... H01C 7/10

[52] U.S. Cl. ..... 338/22 R; 338/22 SD

[58] Field of Search ..... 338/22 R, 22 SD, 25; 374/183, 185, 179, 208, 102

[56] References Cited

U.S. PATENT DOCUMENTS 4,492,947 1/1985 Staats et al. ..... 338/22 R
4,635,026 1/1987 Takeuchi ..... 338/22 R X
4,679,949 7/1987 Sakamoto ..... 338/22 R
4,698,614 10/1987 Welch et al. ..... 338/22 R

*Primary Examiner*—E. A. Goldberg
*Assistant Examiner*—M. M. Lateef
*Attorney, Agent, or Firm*—Polster, Polster and Lucchesi

[57] ABSTRACT

A PTC polymer assembly in which a sheet of PTC polymer is sandwiched between two electrodes, and electric terminations are mechanically and electrically connected to the electrodes, at least one of the terminations is a looped spring connected at one end to one of the electrodes and at another end to a mounting element, with a loop between the electrode and the mounting element to which it is mechanically connected.

8 Claims, 1 Drawing Sheet

POLYMER TYPE PTC ASSEMBLY

BACKGROUND OF THE INVENTION

In certain applications of PTC polymer materials, a sheet of PTC polymer with faces on opposite sides is sandwiched between two electrodes in the form of sheets of electrically conductive material, and electric terminals are mechanically and electrically connected to the electrodes and to mounting elements in an electric circuit. The terminals or terminations are attached to the electrodes with solder or welded. They are likely to be themselves rigid and to be rigidly attached to the mounting elements. For example, in a door lock motor, such a PTC device is snapped into the end cap of a motor on one end and riveted in place at its opposite end.

Stresses placed on the PTC element and it electrodes as a result of attachment in its application and particularly in the elongation of the terminations with temperature when the element is rigidly connected and is cycled in use, can, by placing the polymeric element in shear or tension, cause a permanent change in PTC characteristics.

At the same time, it is desirable that the terminations be dimensionally fixed at the time that they are attached to the mounting element.

One of the objects of this invention is to provide a simple, economically acceptable, and dependable polymeric PTC element construction that will obviate or minimize changes in PTC characteristics as a result of the mounting of the element.

Other objects of this invention will be apparent to those skilled in the art in light of the following description and accompanying drawings.

SUMMARY OF THE INVENTION

In accordance with this invention, generally stated, in a PTC polymer assembly in which a sheet of PTC polymer with faces on opposite sides is sandwiched between two electrodes in the form of sheets of electrically conductive material electrically connected to and substantially coextensive with the opposite faces of the polymer sheet and electrically connected to one another by and through the PTC polymer and electric terminations mechanically and electrically connected to the electrodes and to mounting elements in an electric circuit, at least one of the terminations is a self-supporting spring connected at one end to one of the electrodes and at another to the mounting element, formed to maintain its location during assembly but to provide play between the electrode and the mounting element to which it is mechanically connected during thermal and mechanical relative movement between the PTC element and the mounting element. In the preferred embodiment, the spring takes the form of a U or V loop, and that termination is made of beryllium copper (BeCu). Preferably the termination is made with a flat metal loop, but it may be in the form of a spring wire with an open loop in it.

In either case, the dimensions and positions of the terminations are fixed when they are not forcibly deflected.

DESCRIPTION OF THE PREFERRED EMBODIMENT

Figure 1:
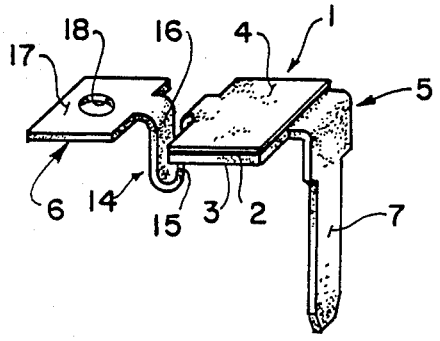
FIG. 1 is a view in perspective of one embodiment of PTC element assembly of this invention.

Referring now to the drawings and particularly to FIG. 1, for a preferred embodiment of this invention, reference numeral 1 indicates a complete assembly, ready for mounting to mounting elements of an electrical circuit, not here shown. The assembly includes a sheet of PTC material 2 sandwiched between a lower electrode 3 and an upper electrode 4. A lower termination 5, is, in this embodiment, integral with the lower electrode 3. An upper termination 6 is, in this embodiment, integral with the upper electrode 4. As will be seen from the drawing, the upper and lower electrodes are substantially coextensive with upper and lower broad faces of the sheet of PTC material 2. The lower termination is provided with a plug-in prong 7, projecting at right angles to the plane of the lower electrode 3.

The upper termination 6 includes a loop 15 with a depending leg 15 and a riser leg 16, and a connector plate 17. The connector plate 17 has a rivet hole 18 in it to receive a rivet connecting it to a mounting element.

In this, illustrative, embodiment, the polymer sheet is approximately 0.010 inch thick. The lower electrode 3 is 0.032 inch thick brass. The upper electrode 4 is 0.012 inch BeCu. For some applications, a 0.020 inch thick brass plate can be welded or otherwise secured to the underside of the connector plate 17. As is customary, both broad surfaces of the polymeric sheet are initially covered by 0.001 inch thick nickel foil, and the upper and lower electrodes 4 and 3 are soldered to the outer surface of the foil. This is conventional.

In mounting, the prong 7 is snapped into the endcap of a motor, for example, and the connector plate 18 is riveted to a fixed mounting terminal. It can be seen that, absent a deforming force, the relative positions of the prong 7 and the hole 18 will remain fixed, so that the installation of the assembly is easily accomplished, and may be automated.

Figure 2:
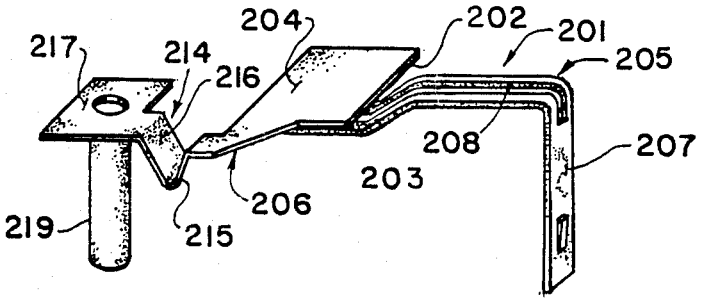
FIG. 2 is a view in perspective of another embodiment of PTC element assembly of this invention.

Referring now to FIG. 2 for another embodiment of this invention, reference numeral 201 indicates the complete assembly, which includes a sheet of polymeric PTC material 202, a lower electrode 203, an upper electrode 204, a lower termination 205, and an upper termination 206. In this embodiment, as in the embodiment shown in FIG. 1, the lower termination 205 is integral with the lower electrode 203, and the upper electrode 204 is integral with the upper termination 206. In this embodiment, a prong 207, of different configuration but same function as the prong 7, extends substantially perpendicularly to the plane of the lower electrode 203, and is provided with a slot 208, extending through a portion of the prong 207 and through a connecting reach of the termination.

The upper termination 206 of this embodiment has a more nearly V-shaped loop 214 than the loop 14, with a depending leg 215 and a riser leg 216, and a connector plate 217. In this embodiment, the connector plate 217 is shown as having a rivet 219 connected to it. The function and operation of this embodiment of PTC assembly 201 are the same as those of the assembly 1.

Figure 3:
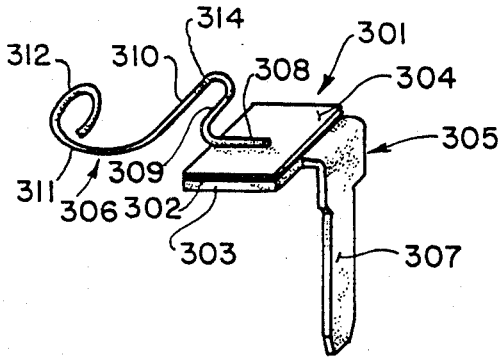
FIG. 3 still another embodiment of PTC element assembly of this invention.

Referring now to FIG. 3 for still another embodiment of this invention, reference numeral 301 represents the completed assembly, which, like the assemblies of the devices shown in FIGS. 1 and 2, has a sheet of PTC material 302, a lower electrode 303, an upper electrode 304, and a lower termination 305, with a plug-in prong 307 corresponding exactly to the electrode 3 and the prong 7 of the embodiment shown in FIG. 1. An upper termination 306 of this embodiment is in the form of a BeCu wire, circular in cross section and about 0.022 inch in diameter. The termination 306 is stiffly resilient. It has an electrode connecting end 308 which is soldered or welded to the upper electrode 304, a loop 314 which, in this embodiment, lies in a plane parallel to the plane of the upper electrode 304, and a connector section 311. The loop 314 is U-shaped, with an outward leg 309 and a return leg 310. The connector section 31 has at its outer end an eye 312 formed by a bend in the wire.

The dimensions of the PTC element, hence the electrodes, and the shapes and dimensions of the terminations will be varied as the requirements of their application vary. In any event, however, the provision of the spring loop reduces the stresses on the PTC element resulting from expansion of the terminations during the heating cycle sufficiently to prevent unacceptable changes in the resistance characteristics of the element, which when the spring is not provided may be as much as fifty percent.

Numerous variations in the construction of the assembly of this invention, within the scope of the appended claims, will occur to those skilled in the art in the light of the foregoing disclosure. The terminations can both be provided with looped springs. They can be formed of materials different from the brass and BeCu given as examples, so long as the termination with the loop is stiffly springy and both are electrically conductive. The type of termination that is broad relative to its thickness can be welded or otherwise secured to the electrode, but making it integral with the electrode has clear advantages. The loop can be a helix or spiral, or of different configuration or construction, as long as it is self-supporting under conditions of installation, and provides play between the PTC element and the mounting clement during thermal or mechanical relative movement between them. These variations are merely illustrative.

I claim:

1. In a PTC polymer assembly in which a sheet of PTC polymer with faces on opposite sides is sandwiched between two electrodes in the form of sheets of electrically conductive material electrically connected to and substantially coextensive with said opposite faces of said polymer sheet and electrically connected to one another by and through said PTC polymer, and first and second electric terminates mechanically and electrically connected to said electrodes and to first and second mounting elements in an electric circuit, the improvement comprising at least one of said first and second terminations being a looped spring fixedly connected at one end to one of said electrodes and fixedly connected at another end to one of said first and second mounting elements, with a looped of said looped spring being disposed between said electrode and said mounting element to which the spring is fixedly and mechanically connected, at the other of said first and second terminations being fixedly connected at one end to the other of the electrodes and fixedly connected at the other end to the other of said first and second mounting elements.

2. The assembly of claim 1 wherein the said looped spring termination is integral with one of said electrodes.

3. The assembly of claim 2 wherein the said looped spring termination is wide relative to its thickness.

4. The assembly of claim 3 wherein the said looped spring termination is beryllium copper.

5. The assembly of claim 1 wherein said looped spring termination is beryllium copper wire.

6. In a PTC polymer assembly in which a sheet of PTC polymer with faces on opposite sides is sandwiched between two electrodes in the form of sheets of electrically conductive material electrically connected to and substantially coextensive with said opposite faces of said polymer sheet and electrically connected to one another by and through said PTC polymer, and first and second electric terminations mechanically and electrically connected to said electrodes and to first and second mounting elements in an electric circuit, the improvement comprising at least one of said first and second terminations being a self-supported spring means for maintaining its location during assembly and thereafter providing play between said PTC element and one of the said mounting elements during thermal and mechanical relative movement between said mounting element and said PTC element, said spring terminations being fixedly connected at one end to one of said electrodes and fixedly connected at another end to said mounting element, the other of said first and second terminations being fixedly connected at one end to the other of the electrodes and being fixedly connected at the other end to the other of said first and second mounting elements.

7. The assembly of claim 6 wherein said spring means is integral with one of said electrodes.

8. The assembly of claim 7 wherein the said spring means is wide relative to its thickness.

* * * * *

UNITED STATES PATENT AND TRADEMARK OFFICE

CERTIFICATE OF CORRECTION

PATENT NO. : 4,831,354

DATED : May 16, 1989

INVENTOR(S) : Charles Yagher, Jr.

It is certified that error appears in the above-identified patent and that said Letters Patent is hereby corrected as shown below:

Column 3, line 14, "31" should be ---311---.

Column 3, line 42, "clement" should be ---element---.

Signed and Sealed this

Twenty-fourth Day of April, 1990

*Attest:*

HARRY F. MANBECK, JR.

*Attesting Officer*

*Commissioner of Patents and Trademarks*